US007756456B2

(12) United States Patent
Hiroe et al.

(10) Patent No.: US 7,756,456 B2
(45) Date of Patent: Jul. 13, 2010

(54) IMAGE FORMING APPARATUS INCLUDING SHIFTED ROLLER

(75) Inventors: Nobuhiro Hiroe, Saitama (JP); Noribumi Sato, Saitama (JP); Yoshishige Sakamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/291,901

(22) Filed: Dec. 2, 2005

(65) Prior Publication Data

US 2006/0291913 A1 Dec. 28, 2006

(30) Foreign Application Priority Data

Jun. 23, 2005 (JP) ..... 2005-183403

(51) Int. Cl.
*G03G 15/20* (2006.01)

(52) U.S. Cl. ..... 399/312; 399/121

(58) Field of Classification Search ..... 399/312, 399/121

See application file for complete search history.

(56) References Cited

U.S. PATENT DOCUMENTS 4,873,541 A * 10/1989 Hirose et al. ..... 347/118
6,108,510 A * 8/2000 Nakane ..... 399/303
6,457,709 B1 * 10/2002 Madsen et al. ..... 399/303
2004/0165910 A1 * 8/2004 Sato et al. ..... 399/116

FOREIGN PATENT DOCUMENTS

JP 2000053270 A * 2/2000
JP 2000-321879 A 11/2000
JP 2002-60085 A 2/2002
JP 2003-201038 A 7/2003
JP 2003-255642 A 9/2003
JP 2003-255718 A 9/2003
JP 2004-203540 A 7/2004

OTHER PUBLICATIONS

English Abstract of JP 2000053270 A to Kurotaka.*

* cited by examiner

*Primary Examiner*—David M Gray
*Assistant Examiner*—Ryan D Walsh
(74) *Attorney, Agent, or Firm*—Sughrue Mion, PLLC

(57) ABSTRACT

An image forming apparatus includes: a belt member stretched across at least two rollers; a protrusion disposed, such that it protrudes along the traveling direction of the belt member, on an inner surface of one edge side of the belt member; an engagement portion that is formed in an end portion of the rollers and with which the protrusion is engageable; and an image carrier that retains a toner image transferred to a recording medium conveyed by the belt member or the surface of the belt member. The end portion at the opposite side, in the width direction of the belt member, of one roller of the rollers is shifted in the direction where it separates from the image carrier and axially supported.

11 Claims, 8 Drawing Sheets

IMAGE FORMING APPARATUS INCLUDING SHIFTED ROLLER

CROSS-REFERENCE TO RELATED APPLICATION

This application claims priority under 35 USC 119 from Japanese Patent Application No. 2005-183403, the disclosure of which is incorporated by reference herein.

BACKGROUND OF THE INVENTION

1. Field of the Invention

The present invention relates to an image forming apparatus including a belt member stretched across at least two rollers.

2. Description of the Related Art

Conventionally, image forming apparatus have been known where a toner image transferred to an intermediate transfer belt by a photosensitive body (image carrier) is transferred/fixed to recording paper (a recording medium) to form an image. In such image forming apparatus, a belt member, such as a conveyor belt that conveys the recording paper or an intermediate transfer belt, is stretched across and travels around at least two rollers. Thus, there has been the problem that the belt member travels while moving toward one side in the axial direction of the two rollers.

For this reason, conventionally, from the standpoint of keeping the apparatus inexpensive, image forming apparatus have been configured to prevent the moving (meandering) of the belt member in the axial direction by disposing a rib-like protrusion on the inner surface (undersurface) of one edge (or width-direction end portion) side of the belt member such that the rib-like protrusion protrudes along the traveling direction of the belt member, and forming a recessed groove, with which the rib-like protrusion can engage (into which the rib-like protrusion can be inserted), in one axial-direction end portion side of the rollers (e.g., see Japanese Patent Application Publication (JP-A) No. 2000-321879).

Even if the image forming apparatus is configured in this manner, there is the problem that the belt member travels while moving toward one side in the axial direction of the rollers because there is clearance in the axial direction of the rollers between the rib-like protrusion and the recessed groove. In this case, no particular problems arise if the belt member travels while moving toward the end portion at the opposite side where the rib-like protrusion is not protrudingly disposed.

However, if the belt member travels while moving toward the one end portion side where the rib-like protrusion is protrudingly disposed, the portion of the belt member in the vicinity of the rib-like protrusion bends such that it curves, and a phenomenon occurs where the belt member rises up from the rollers. When this phenomenon occurs, there is the potential for trouble to occur, such as the rib-like protrusion coming out of the recessed groove or the rib-like protrusion separating from the inner surface (undersurface) of the belt member.

In order to solve this problem, a configuration is conceivable where rib-like protrusions are disposed on both end portion sides of the belt member and recessed grooves are disposed in both end portion sides of the rollers, or where a jig that holds down the separate belt member is disposed, but in either case there is the drawback that the apparatus becomes expensive (costs are incurred).

SUMMARY OF THE INVENTION

In view of these circumstances, it is an object of the present invention to obtain an image forming apparatus configured to be able to ensure the traveling stability of the belt member without incurring costs.

In order to achieve this object, an image forming apparatus of a first aspect of the invention comprises: a belt member stretched across at least two rollers; a protrusion disposed, such that it protrudes along the traveling direction of the belt member, on an inner surface of one edge side of the belt member; an engagement portion that is formed in an end portion of the rollers and with which the protrusion is engageable; and an image carrier that retains a toner image transferred to a recording medium conveyed by the belt member or the surface of the belt member, wherein the end portion at the opposite side, in the width direction of the belt member, of one roller of the rollers is shifted and axially supported in the direction where it separates from the image carrier.

According to this invention, the belt member is made to travel while always being regulated such that it moves toward the side where the protrusion is not protrudingly disposed (the side where the engagement portion is not formed). Consequently, the traveling stability of the belt member can be ensured. In other words, because drawbacks such as the belt member bending and rising up from the rollers do not occur, trouble such as the protrusion coming out of the engagement portion or the protrusion separating form the belt member does not arise. Also, the drawback of costs being incurred does not arise because it suffices simply for the axial center position of the roller to be shifted.

An image forming apparatus of a second aspect of the invention comprises: a belt conveyance unit including a belt member that is stretched across at least two rollers and conveys a recording medium, a protrusion disposed, such that it protrudes along the traveling direction of the belt member, on an inner surface of one edge side of the belt member, an engagement portion that is formed in an end portion of the rollers and with which the protrusion is engageable, and a casing that axially supports the rollers; a body frame including an image carrier for transferring an image to the recording medium; and a cover to which the belt conveyance unit is attached, is pivotably attached to the body frame, and opens and closes off the image carrier, wherein when the cover pivots toward the body frame and closes off the image carrier, the casing contacts the body frame, whereby the end portion at the opposite side, in the width direction of the belt member, of one roller of the rollers is shifted in the direction where it separates from the image carrier.

DETAILED DESCRIPTION OF THE INVENTION

Figure 1:
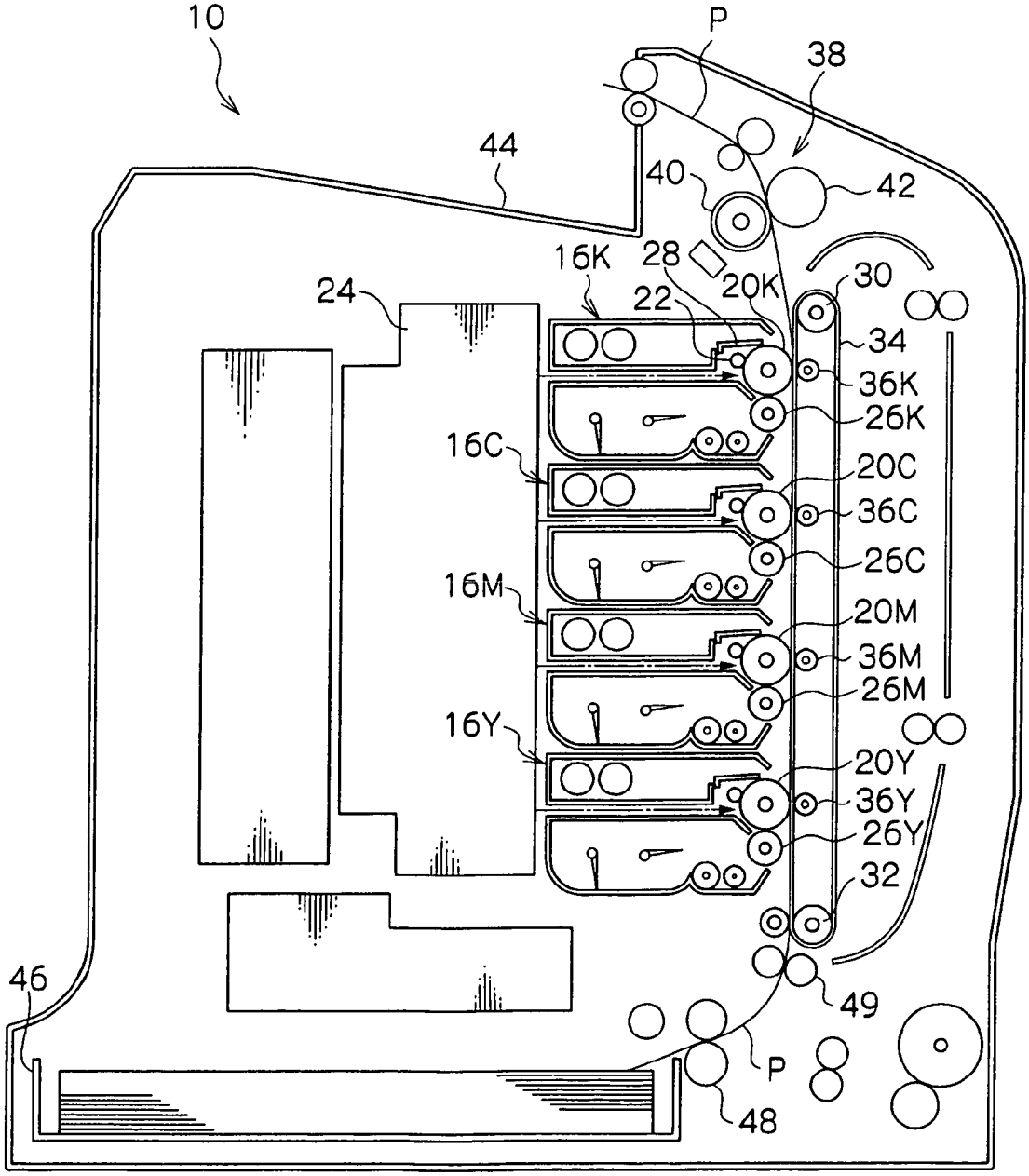
FIG. 1 is a schematic side view showing the configuration of an image forming apparatus pertaining to an embodiment of the invention.

An embodiment of the invention will be described in detailed below on the basis of examples shown in the drawings. In the drawings, sometimes the letters "Y," "M," "C" and "K" are added at the end of reference numerals in regard to elements disposed for the respective colors of yellow (Y), magenta (M), cyan (C) and black (K).

Figure 2:
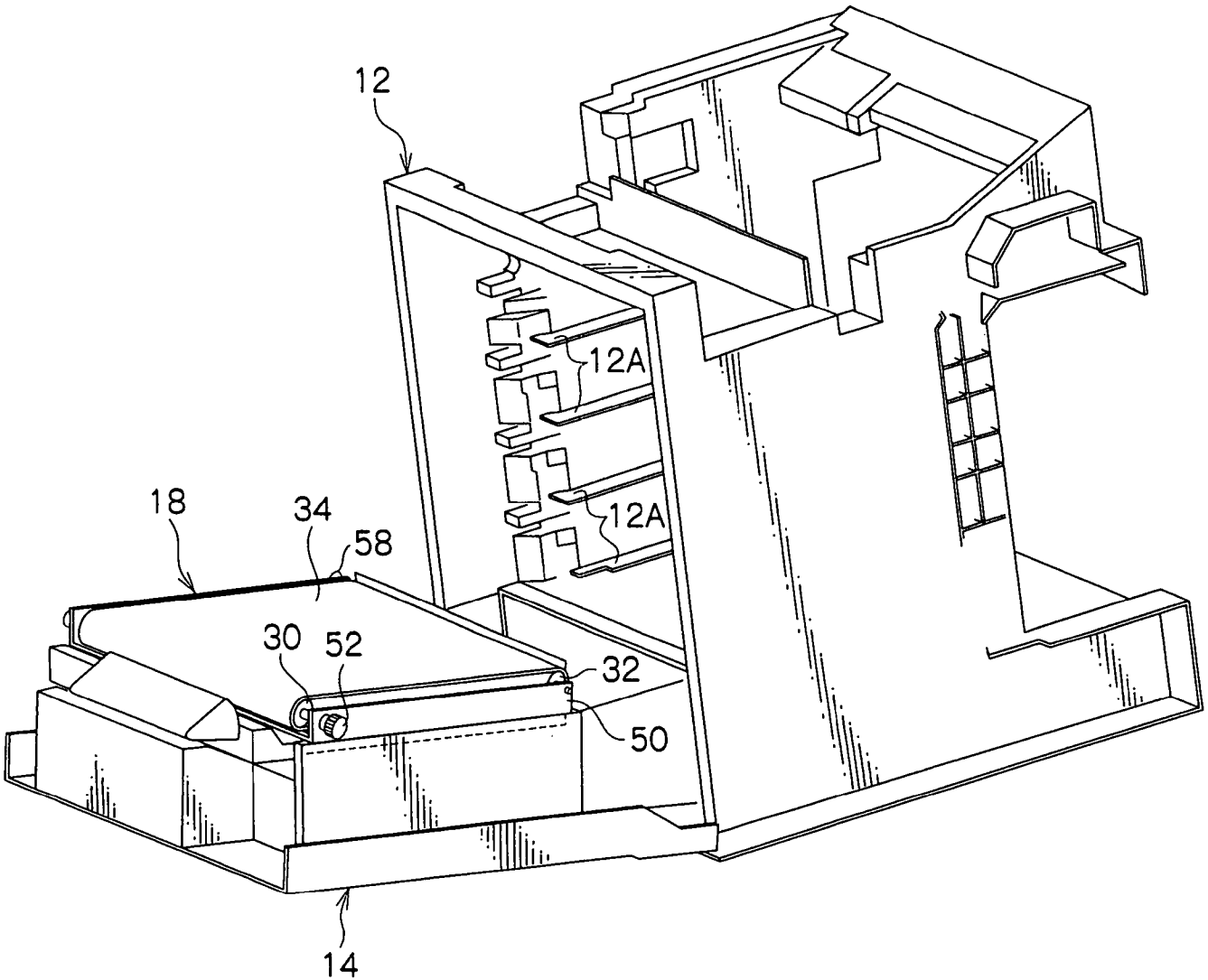
FIG. 2 is a schematic perspective view showing a body frame and a cover to which a conveyance unit is attached.

First, the overall configuration of an image forming apparatus 10 pertaining to the invention will be described. As shown in FIGS. 1 and 2, the image forming apparatus 10 includes a body frame 12, which detachably houses image carriers (photosensitive bodies) 20 and development units 16, and a cover 14, which opens and closes off the image carriers 20 and the development units 16. A conveyance unit 18 disposed with a conveyor belt 34 that sucks and conveys recording paper P is detachably attached to the cover 14.

The development units 16 include: a charge roller 22 that uniformly charges the surface of the roll-like image carrier 20; an optical box 24 that irradiates the image carrier 20 with image light on the basis of image data to form a latent image resulting from the difference in electrostatic potential; a development roller 26 that selectively spreads and visualizes toner to the latent image; and a cleaning member 28 that slidingly contacts the image carrier 20 after the toner image has been transferred to the image carrier 20 and cleans any toner remaining on the image carrier 20.

Each image carrier 20 includes a photosensitive layer on its surface (peripheral surface). After the surface (peripheral surface) of the image carrier 20 has been uniformly charged by the charge roller 22, the surface (peripheral surface) of the image carrier 20 is exposed to the laser light (image light) emitted from the optical box 24, and the electric potential of the exposed portion is reduced, whereby an electrostatic latent image (an image) is formed on the surface of the image carrier 20. The charge roller 22 contacts the image carrier 20, a voltage is applied between the charge roller 22 and the image carrier 20, and discharge occurs in the minute gap in the vicinity of the area where the charge roller 22 contacts the image carrier 20, whereby the charge roller 22 substantially uniformly charges the surface (peripheral surface) of the image carrier 20.

The optical box 24 scans the surface (peripheral surface) of the image carrier 20 with blinking laser light to form the electrostatic latent image based on image data on the surface (peripheral surface) of the image carrier 20. The optical box 24 may be configured to include an arrangement of light-emitting elements such as LEDs and cause these to blink on the basis of image data.

The development roller 26 is disposed such that it is proximate to, and faces, the image carrier 20, and a development bias voltage is applied between the development roller 26 and the image carrier 20. Thus, a development bias electric field is formed between the development roller 26 and the image carrier 20, and toner having an electrical charge is spread to the exposed portion on the image carrier 20 to form a visible image.

The conveyance unit 18 includes a conveyor belt 34 that is stretched across at least the drive roller 30 and the driven roller 32. Plural (four, in correspondence to later-described colors) transfer rollers 36 are disposed at predetermined intervals at predetermined positions between the drive roller 30 and the driven roller 32 at the inner surface side of the conveyor belt 34.

When the cover 14 is closed (when the cover 14 pivots toward the body frame 12 to close off the image carriers 20 and the like), the transfer rollers 36 face the image carriers 20 such that the conveyor belt 34 is sandwiched therebetween, and a transfer electric field is formed between the transfer rollers 36 and the image carriers 20, whereby the toner images (unfixed images) on the surfaces of the image carriers 20 are transferred onto the recording paper P, which is sucked and conveyed on the conveyor belt 34.

Here, the development units 16 are vertically disposed in the order (beginning at the bottom) of yellow (Y), magenta (M), cyan (C) and black (K), for example. The development units 16Y to 16K are housed in a state where both their right- and left-end lower portions are supported by support portions 12A disposed in the body frame 12. A fixing device 38 is disposed downstream (in the upper portion of the body frame 12) of the development units 16Y to 16K in the conveyance direction of the recording paper P.

The fixing device 38 includes a heating roller 40 and a pressure roller 42 whose peripheral surfaces face and contact each other with a predetermined pressure (to form a nip). The unfixed toner images transferred onto the recording paper P are heated/pressured by the heating roller 40 and the pressure roller 42, whereby the toner images are fixed to the recording paper P.

After the toner images have been transferred onto the recording paper P as a result of being heated/pressured by the fixing device 38 (the heating roller 40 and the pressure roller 42), the recording paper P is discharged onto a paper discharge tray 44. Then, after the toner images have been transferred to the recording paper P, the surfaces (peripheral surfaces) of the image carriers 20 are cleaned by the cleaning members 28 so that the image carriers 20 are ready for the next image creation process.

A detachable paper supply cassette 46 is disposed in the lower portion of the body frame 12. The paper supply cassette 46 is configured such that it can be pulled out in the direction opposite to the direction in which the recording paper P is fed and such that it can appropriately supply the recording paper P.

A paper supply roller pair 48 that feeds the recording paper P one sheet at a time from the paper supply cassette 46 is disposed in the vicinity of the front end portion of the paper supply cassette 46. The recording paper P fed from the paper supply roller pair 48 is fed at a predetermined timing by a registration roller pair 49 to a suction/conveyance surface of the conveyor belt 34 and conveyed to positions where the toner images of the respective colors are transferred.

Next, the conveyance unit 18, which is detachably attached to the cover 14 in the image forming apparatus 10 having the above-described configuration, will be described in greater detail. The conveyance unit 18 includes a substantially rectangular, frame-like casing 50. The drive roller 30 is rotatably axially supported on one end portion (upper end portion) of the casing 50, and the driven roller 32 is rotatably axially supported on the other end portion (lower end portion) of the casing 50. The conveyor belt 34, which is configured to electrostatically suck the recording paper P, is wound around/stretched across the drive roller 30 and the driven roller 32.

The transfer rollers 36Y to 36K are disposed at predetermined intervals per color between the drive roller 30 and the driven roller 32 at the inner surface side of the conveyor belt 34. The transfer rollers 36Y to 36K are also rotatably axially supported on the casing 50 (see FIG. 1). The transfer rollers 36Y to 36K are configured such that when the cover 14 is closed, they contact the image carriers 20Y to 20K with a predetermined pressure so that the conveyor belt 34 is sandwiched therebetween, and rotate following the travel of the conveyor belt 34.

Figure 3:
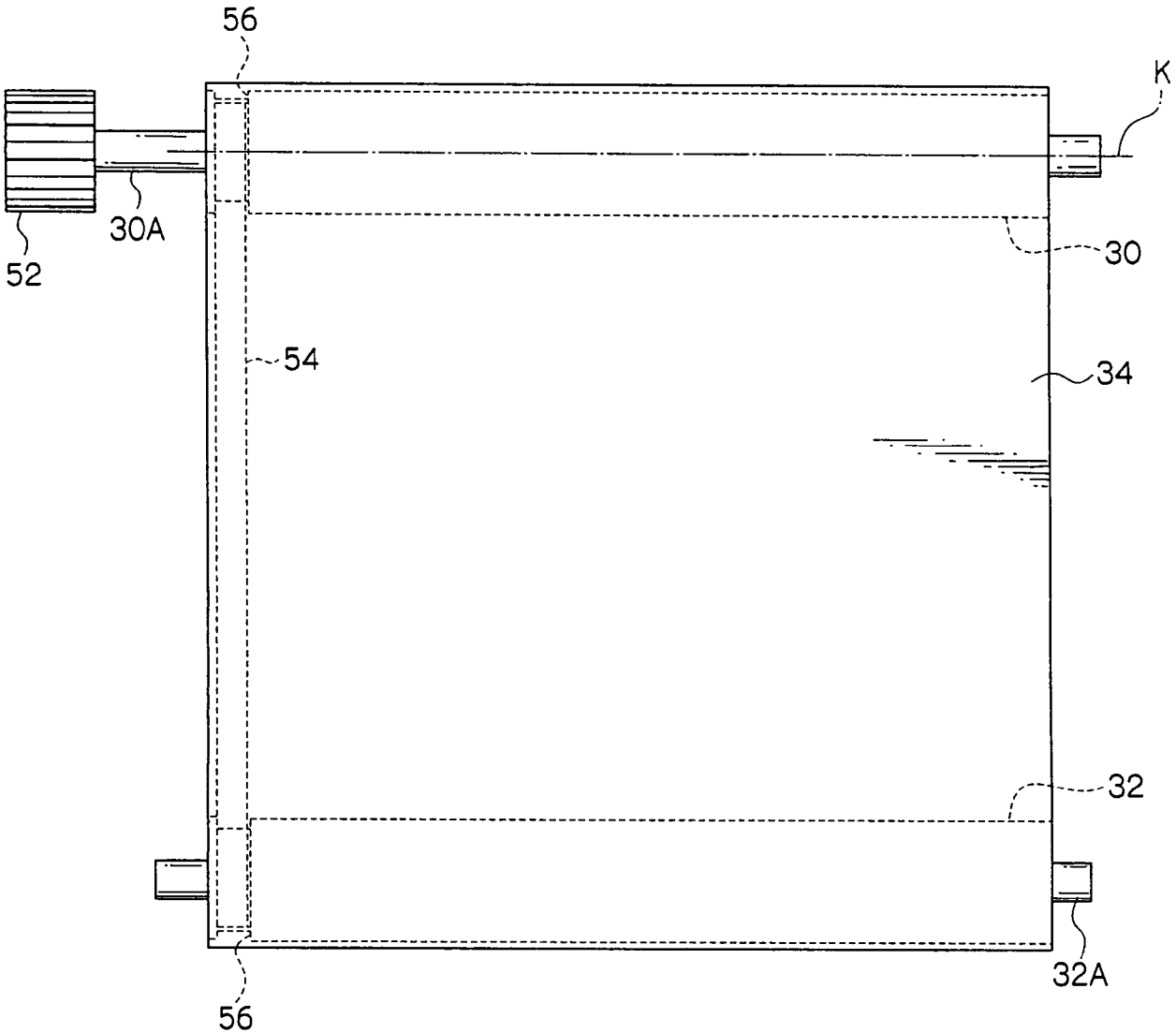
FIG. 3 is a schematic front view of the conveyance unit.
Figure 4:
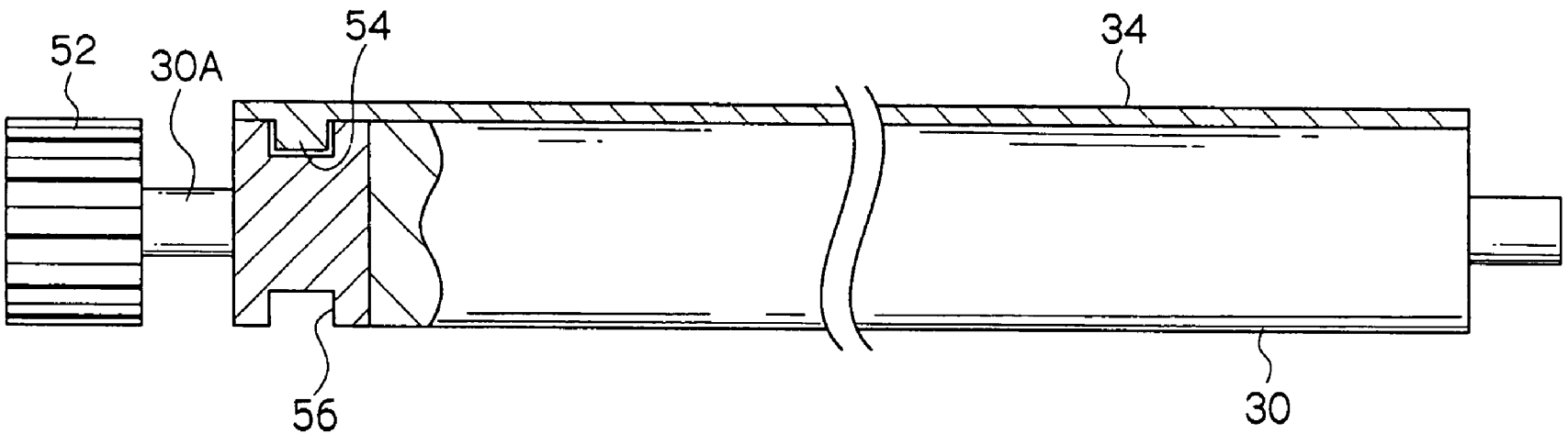
FIG. 4 is a partial broken schematic front view of a drive roller.

As shown in FIGS. 3 and 4, a gear 52 that transmits rotational power to the drive roller 30 is fixedly attached to one end portion of a rotating shaft 30A of the drive roller 30 protruding outward from the casing 50. A rib-like protrusion 54 is disposed, such that it linearly protrudes along the traveling direction of the conveyor belt 34, on the inner surface (undersurface) of the conveyor belt 34 at the side where the gear 52 is attached.

A recessed groove 56 is formed in the circumferential direction at a predetermined position in the drive roller 30 and the driven roller 32 at the side where the gear 52 is attached. The rib-like protrusion 54 is engageable with (insertable into) the recessed groove 56. Consequently, it is difficult for the conveyor belt 34 to meander in the axial direction of the drive roller 30 and the driven roller 32. In other words, it is difficult for the conveyor belt 34 to move in the axial direction of the drive roller 30 and the driven roller 32 while the conveyor belt 34 is traveling.

Figure 5:
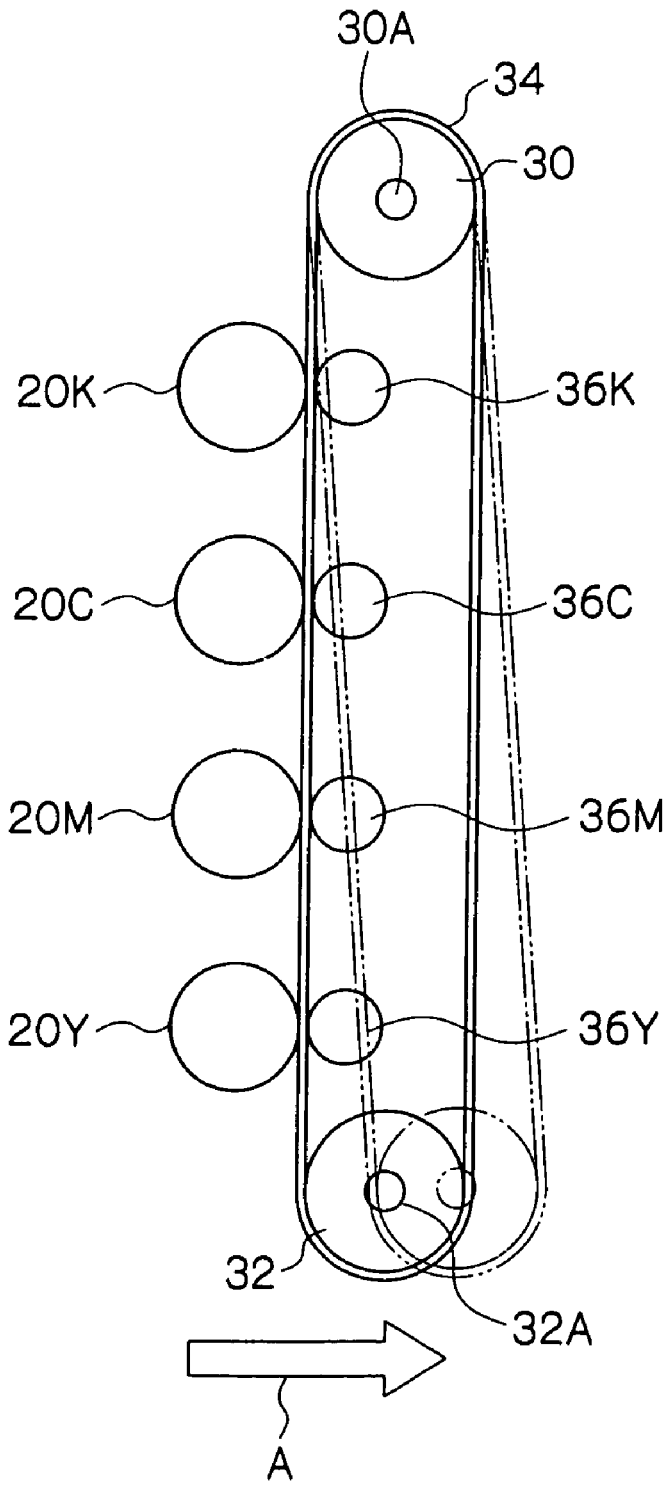
FIG. 5 is a schematic side view of the conveyance unit.
Figure 6:
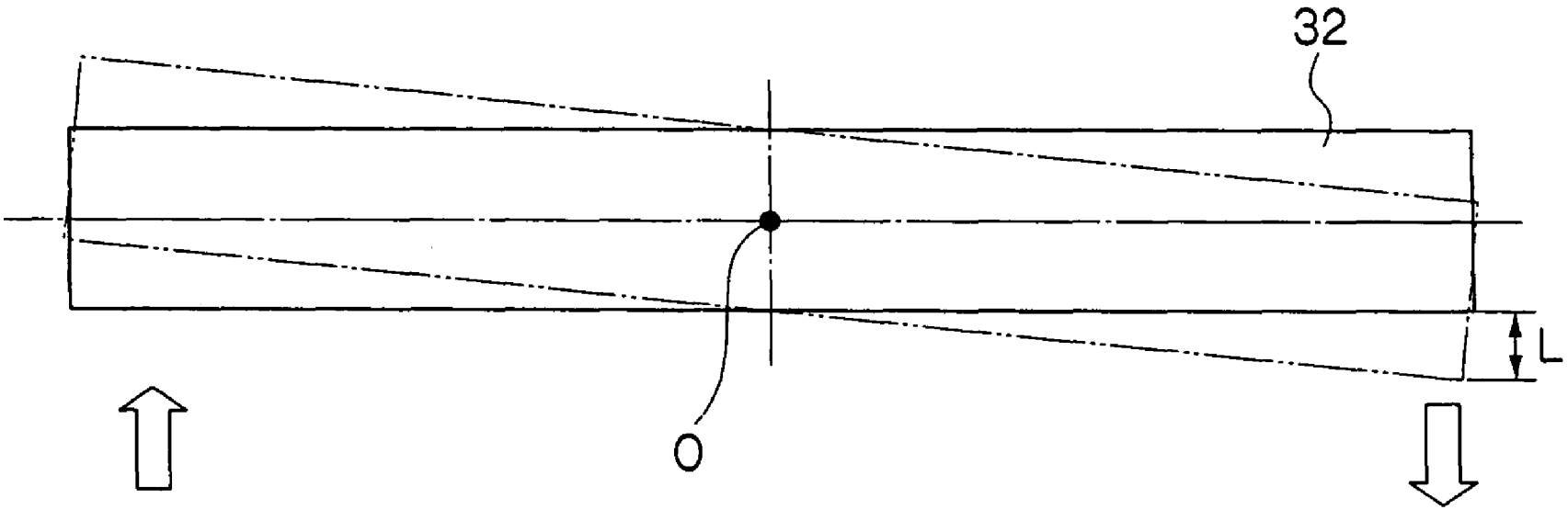
FIG. 6 is an exaggerated schematic plan view showing the inclination angle of a driven roller.

As exaggerated in FIGS. 5 and 6, the driven roller 32 is axially supported on the casing 50 in a state where the end portion at the opposite side of the driven roller 32 where the recessed groove 56 is not formed is slightly shifted in the direction away from the image carriers 20 (in the direction of arrow A in FIG. 5). In the plan view of FIG. 6, for example, assuming that L represents the maximum distance of the endmost portion of the driven roller 32 from the state where the conveyor belt 34 is contacting the image carriers 20 with the ordinary predetermined pressure (state where it is parallel to the conveyor belt 34), the amount of the shift in this case is such that L equals about 0.5 mm.

Figure 7:
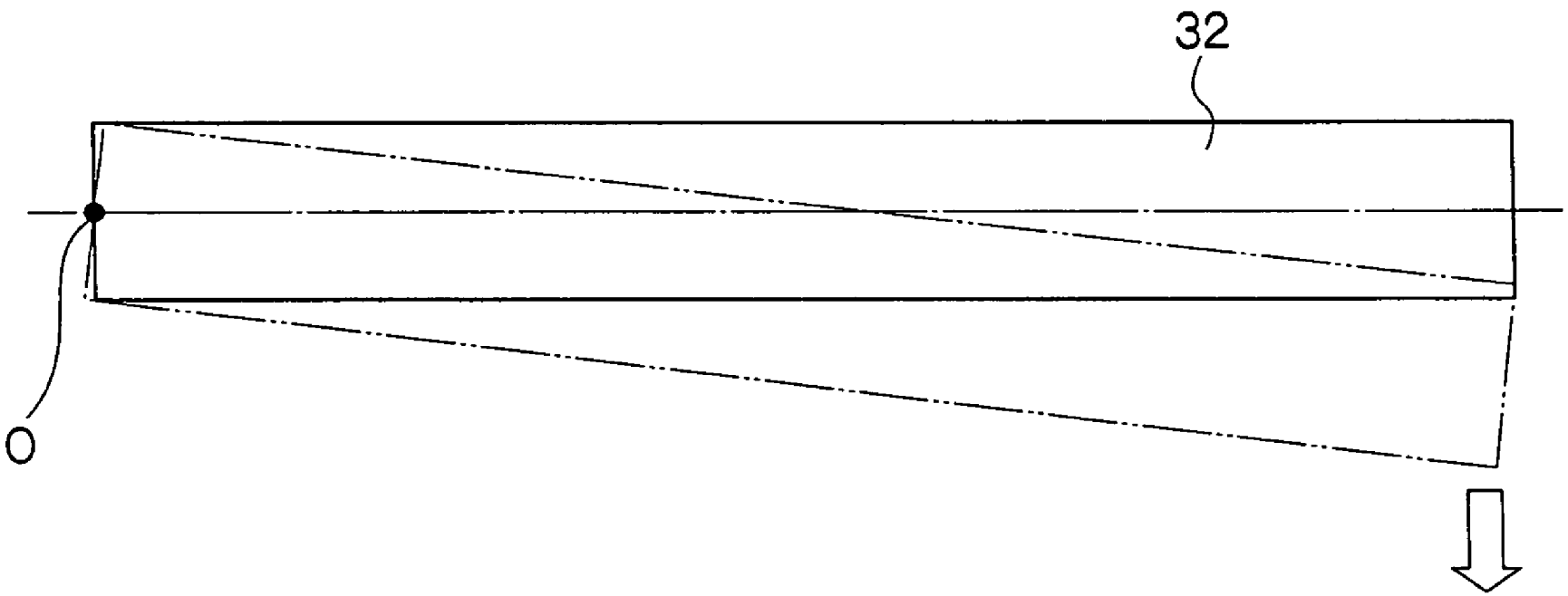
FIG. 7 is an exaggerated schematic plan view showing the inclination angle of the driven roller.

The center position O serving as the rotational reference position when the end portion at the opposite side of the driven roller 32 is shifted as described above may be at the axial-direction center portion of the driven roller 32, as shown in FIG. 6, or at the endmost portion of the driven roller 32 at the side where the recessed groove 56 is formed, as shown in FIG. 7. In either case, it suffices as long as the axial support position of the rotating shaft 32A at the end portion side is shifted such that the end portion of the driven roller 32 at the side where the recessed groove 56 is not formed (where the rib-like protrusion 54 is not protrudingly disposed) slightly separates from the image carriers 20 without the minimum distance between the center position O and the axial center line K (see FIG. 3) of the drive roller 30 changing.

Next, the action of the image forming apparatus 10 having the above configuration will be described. First, the recording paper P is removed one sheet at a time by the paper supply roller pair 48 from the paper supply cassette 46, and fed at a predetermined timing onto the conveyor belt 34 by the registration roller pair 49. The recording paper P fed onto the conveyor belt 34 is electrostatically sucked by the conveyor belt 34 and conveyed to the image carriers 20Y to 20K of the respective colors.

In the development units 16, first, the surfaces (peripheral surfaces) of the image carriers 20 are uniformly charged by the charge rollers 22. Then, the surfaces (peripheral surfaces) of the image carriers 20 are scanned with laser light (image light) from the optical box 24, and electrostatic latent images based on image data are formed on the surfaces (peripheral surfaces) of the image carriers 20. Thereafter, toner images are transferred onto the image carriers 20 by the development rollers 26, and visible images are formed on the surfaces (peripheral surfaces) of the image carriers 20.

When the visible images are formed on the surfaces (peripheral surfaces) of the image carriers 20 in this manner, the toner images (unfixed images) on the surfaces of the image carriers 20 are transferred by the image carriers 20 and the transfer rollers 36 onto the recording paper P, which is sucked and conveyed by the conveyor belt 34. This is conducted in the order of yellow (Y), magenta (M), cyan (C) and black (K). When a full-color toner image (unfixed image) has been transferred onto the recording paper P, the recording paper P is conveyed by the conveyor belt 34 to the fixing device 38.

The unfixed toner image transferred onto the recording paper P conveyed to the fixing device 38 is heated/pressured and fixed by the heating roller 40 and the pressure roller 42. Then, the recording paper P on which the toner image has been fixed by the fixing device 38 is discharged onto the paper discharge tray 44. After the toner images have been transferred to the recording paper P, the surfaces (peripheral surfaces) of the image carriers 20 are cleaned by the cleaning members 28 so that the image carriers 20 are ready for the next image creation process.

Here, as shown in FIGS. 5 and 6, the driven roller 32 is axially supported on the casing 50 in a state where the axial support position of the rotating shaft 32A of the end portion side is shifted a predetermined amount such that the end portion side where the recessed groove 56 is not formed slightly separates from the image carriers 20. Consequently, the conveyor belt 34 can travel while always being regulated such that it moves toward the side where the rib-like protrusion 54 is not protrudingly disposed (where the recessed groove 56 is not formed), and the traveling stability of the conveyor belt 34 is ensured.

In other words, by configuring the invention in this manner, the drawback does not occur where the portion of the conveyor belt 34 in the vicinity of the rib-like protrusion 54 bends such that that portion rises up from the rollers 30 and 32. Thus, trouble such as the rib-like protrusion 54 coming out of the recessed groove 56 or the rib-like protrusion 54 separating from the inner surface (undersurface) of the conveyor belt 34 does not arise.

Also, because the driven roller 32 is a roller configuring the transfer surface (contact surface) of the conveyor belt 34 when the toner images (unfixed images) are transferred to the recording paper P by the image carriers 20, the positional shift of the transfer surface (contact surface) in the main scanning direction (axial direction of the drive roller 30) can be appropriately suppressed. Consequently, color registration can be improved when printing in full color.

Moreover, because the roller that is shifted a predetermined amount with respect to the image carriers 20 is the driven roller 32 (i.e., because it is not the drive roller 30), it is easy for this roller to shift in terms of the configuration, and the minimum distance between the center position O serving as the rotational reference position when the driven roller 32 is shifted (tilted) and the axial center line K of the drive roller 30 does not change (is constant). Thus, fluctuation in the tension of the conveyor belt 34 can be suppressed. Consequently, drawbacks such as the traveling stability of the conveyor belt 34 being compromised do not arise.

As the method of shifting the end portion of the driven roller 32 at the side where the recessed groove 56 is not formed in the direction where it slightly separates from the surfaces (peripheral surfaces) of the image carriers 20, the following method may be adopted other than shifting the axial center position of the rotating shaft 32A of the end portion side and axially supporting the driven roller 32 on the casing 50.

Namely, as shown in FIG. 2, for example, a convex portion 58 having a predetermined height may be disposed on one edge portion (the edge portion at the side where the recessed groove 56 is not formed) of the casing 50 contacting the body frame 12, such that when the cover 14 is closed, the resin-made casing 50 is bent (twisted) by the convex portion 58 and the end portion of the driven roller 32 at the side where the recessed groove 56 is not formed slightly separates from the image carriers 20.

In this case, there is the advantage that the invention can be easily configured because it suffices for the convex portion 58 to be protrudingly disposed on the edge portion of the casing 50. The shape, position, and numerical quantity of the convex portion 58 may be appropriately designed/changed. The convex portion 58 may be protrudingly disposed on the body frame 12, or may be protrudingly disposed on both the casing 50 and the body frame 12.

Figure 8:
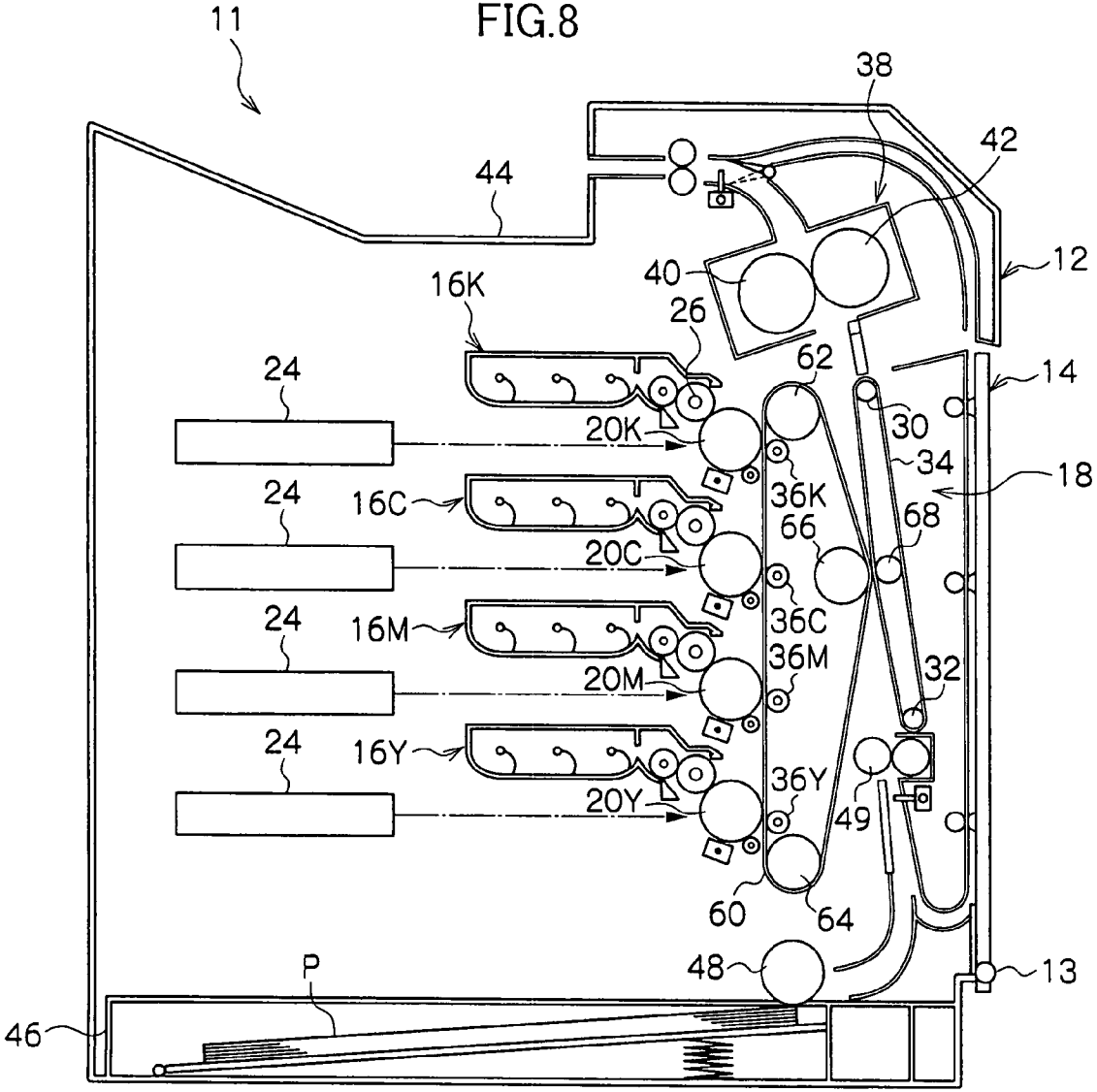
FIG. 8 is a schematic side view showing the configuration of an image forming apparatus disposed with an intermediate transfer belt.

Next, a modified example of the image forming apparatus pertaining to the invention will be described. FIG. 8 shows an image forming apparatus 11 that is different from the image forming apparatus 10 in that the image forming apparatus 11 is disposed with an intermediate transfer belt 60. Consequently, the same reference numerals will be given to portions having the same functions as those of the image forming apparatus 10, and detailed description of those portions will be omitted.

As shown in FIG. 8, the conveyance unit 18 is detachably attached to the cover 14, and the cover 14 is pivotably attached to the body frame 12 via a hinge portion 13. The conveyor belt 34 is stretched across the drive roller 30 and the driven roller 32, and a backup roller 68 is disposed at an appropriate position between the drive roller 30 and the driven roller 32.

The intermediate transfer belt 60 is stretched across a drive roller 62, a driven roller 64, and a tension roller 66. Similar to what was described above, a rib-like protrusion (not shown) is also protrudingly disposed on the intermediate transfer belt 60. And similar to what was described above, a recessed groove (not shown) is also formed in the drive roller 62 and the driven roller 64. The transfer rollers 36Y to 36K of the respective colors are disposed at appropriate positions between the drive roller 62 and the driven roller 64 opposite from the tension roller 66.

Consequently, the toner images (unfixed images) transferred onto the intermediate transfer belt 60 by the image carriers 20Y to 20K and the transfer rollers 36Y and 36K of the respective colors are transferred onto the recording paper P, which is sucked and conveyed by the conveyor belt 34, at the site where the intermediate transfer belt 60 and the conveyor belt 34 are brought into sliding contact with each other by the tension roller 66 and the backup roller 68. Thereafter, the toner images are fixed by the fixing device 38.

In the image forming apparatus 11 having this configuration, the driven roller 64 of the intermediate transfer belt 60 is configured in the same manner as described above. Namely, the driven roller 64 is axially supported on a casing (not shown) for the intermediate transfer belt 60 in a state where the axial center portion of the rotating shaft at the end portion side is shifted a predetermined amount such that the end portion side of the driven roller 64 where the recessed groove is formed slightly separates from the image carriers 20.

Thus, the intermediate transfer belt 60 can travel while always being regulated such that it moves toward the side where the rib-like protrusion is not protrudingly disposed (where the recessed groove is not formed), and the traveling stability of the intermediate transfer belt 60 is ensured. In other words, similar to what was described above, the bending of portion of the intermediate transfer belt 60 in the vicinity of the rib-like protrusion, such that that portion rises up from the rollers 62 and 64, is prevented, and separation of the rib-like protrusion from the inner surface (undersurface) of the intermediate transfer belt 60 is prevented.

Also, similar to what was described above, because the driven roller 64 is a roller configuring a transfer surface (contact surface) when the toner images (unfixed images) are transferred to the intermediate transfer belt 60 by the image carriers 20, the positional shift of the transfer surface (contact surface) in the main scanning direction (axial direction of the drive roller 62) can be appropriately suppressed. Consequently, color registration can be improved when printing in full color.

Moreover, because the roller that is shifted a predetermined amount with respect to the image carriers 20 is the driven roller 64 (i.e., because it is not the drive roller 62), it is easy for this roller to shift in terms of the configuration, and the minimum distance between the center position serving as the rotational reference position when the driven roller 64 is shifted (tilted) and the axial center line of the drive roller 62 does not change (is constant). Thus, fluctuation in the tension of the intermediate transfer belt 60 can be suppressed. Consequently, drawbacks such as the traveling stability of the intermediate transfer belt 60 being compromised do not arise.

Effects to a certain extent can be obtained even if the tension roller 66 is configured like the driven roller 64, but the longer the length (wrap length) of the belt member wound around the rollers is, the higher the regulation performance becomes for the rollers to cause the belt member to move to one side. Thus, it is effective for the driven roller 64, where the wrap amount of the intermediate transfer belt 60 is greater than that of the tension roller 66, to be configured as described above, which is preferable.

In an aspect of the image forming apparatus of the invention, a convex portion may be formed on the casing or the body frame and cause the casing to bend, whereby the end portion at the opposite side, in the width direction of the belt member, of the one roller is shifted in the direction where it separates from the image carrier.

According to this invention, the belt member is made to travel while always being regulated such that it moves toward the side where the protrusion is not protrudingly disposed (the side where the engagement portion is not formed). Consequently, the traveling stability of the belt member can be ensured. In other words, because drawbacks such as the belt member bending and rising up from the rollers do not occur, trouble such as the protrusion coming out of the engagement portion or the protrusion separating from the belt member does not arise. Also, the invention can be easily configured and the drawback of costs being incurred does not arise because it suffices simply for the convex portion to be formed such that the casing axially supporting the rollers bends.

In this invention, the engagement portion formed on the end portion of the rollers may be the same member as the rollers or a separate member disposed on the end portion of the rollers. The shape of the engagement portion may be optional, such as a recessed groove into which the protrusion of the belt member is inserted, or an L-shape against which the belt member slides. Also, in the invention, the body frame disposed with the image carrier includes a frame that indirectly supports the image carrier and parts disposed in that frame.

In the image forming apparatus of any of the above aspects, the one roller may be a roller configuring a contact surface of the belt member that contacts the image carrier.

In this aspect, it becomes difficult for positional displacement in the main scanning direction (axial direction of the roller) of the contact surface of the belt member contacting the image carrier to arise. Thus, color registration can be improved when printing in full color.

In the image forming apparatus of any of the above aspects, the one roller may be a non-driven roller.

In this aspect, there is the advantage that it is easy to shift the position of the roller because the shifting roller is a non-driven roller.

Also, in the image forming apparatus applying the non-driven roller, a minimum distance between a center position serving as a rotational reference position when the non-driven roller shifts and an axial center line of a drive roller may be constant.

In this aspect, fluctuation in the tension of the belt member can be suppressed. Consequently, drawbacks such as the traveling stability of the belt member being compromised do not arise.

As described above, according to the present invention, an image forming apparatus can be provided which can ensure the traveling stability of the belt member without incurring costs.

What is claimed is:

1. An image forming apparatus comprising:

a belt member stretched across at least two rollers, each of the at least two rollers including a first end portion and a second end portion;

a protrusion disposed, such that it protrudes along the traveling direction of the belt member, on an inner surface of one edge side of the belt member;

an engagement portion that is formed in the first end portion of the rollers and with which the protrusion is engageable; and a plurality of image carriers arranged in a line, wherein each image carrier carries a toner image transferred to a recording medium conveyed by the belt member or the surface of the belt member, wherein the second end portion of one roller of the at least two rollers is shifted with respect to the first end portion of the one roller in a direction away from and orthogonal to the line of the image carriers, and the second end portion of an other roller of the at least two rollers is not shifted with respect to the first end portion of the other roller in a direction away from the image carrier; and wherein the second end portion of one roller is drawn away from the line of the plurality of image carriers and the first end portion of the one roller is not drawn away from the line of the plurality of rollers.

2. The image forming apparatus of claim 1, wherein the one roller is a roller configuring a contact surface of the belt member that contacts the image carriers.

3. The image forming apparatus of claim 1, wherein the one roller is a non-driven roller.

4. The image forming apparatus of claim 3, wherein a minimum distance between a center position serving as a rotational reference position when the non-driven roller shifts and an axial center line of a drive roller is constant.

5. The image forming apparatus of claim 1, wherein the one roller is axially supported on a casing.

6. The image forming apparatus of claim 1, wherein the first end portion of the one roller is adjacent to the line of the image carriers and the second end portion of the one roller is separated from the line of the image carriers.

7. An image forming apparatus comprising:

a belt conveyance unit including a belt member that is stretched across at least two rollers and conveys a recording medium, each of the at least two rollers including a first end portion and a second end portion, a protrusion disposed, such that it protrudes along the traveling direction of the belt member, on an inner surface of one edge side of the belt member, an engagement portion that is formed in the first end portion of the rollers and with which the protrusion is engageable, and a casing that axially supports the rollers;

a body frame including an image carrier for transferring an image to the recording medium; and a cover to which the belt conveyance unit is attached, is pivotably attached to the body frame, and opens and closes off the image carrier, wherein when the cover pivots toward the body frame and closes off the image carrier, the casing contacts the body frame, whereby the second end portion of one roller of the at least two rollers is shifted with respect to the first end portion of the one roller in a direction away from the image carrier.

8. The image forming apparatus of claim 7, wherein a convex portion is formed on the casing or the body frame and causes the casing to bend, whereby the second end portion of the one roller is shifted in the direction where it separates from the image carrier.

9. The image forming apparatus of claim 7, wherein the one roller is a roller configuring a contact surface of the belt member that contacts the image carrier.

10. The image forming apparatus of claim 7, wherein the one roller is a non-driven roller.

11. The image forming apparatus of claim 10, wherein a minimum distance between a center position serving as a rotational reference position when the non-driven roller shifts and an axial center line of a drive roller remains constant.

* * * * *